US007565877B2

(12) United States Patent
Sablok et al.

(10) Patent No.: US 7,565,877 B2
(45) Date of Patent: Jul. 28, 2009

(54) SPAR PLATFORM HAVING CLOSED CENTERWELL

(75) Inventors: Anil Sablok, Houston, TX (US); Walter Wade Mallard, Houston, TX (US); Richard Davies, Katy, TX (US); Lyle Finn, Sugar Land, TX (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 11/840,039

(22) Filed: Aug. 16, 2007

(65) Prior Publication Data

US 2008/0041292 A1 Feb. 21, 2008

Related U.S. Application Data

(60) Provisional application No. 60/822,631, filed on Aug. 16, 2006.

(51) Int. Cl.
*B63B 35/44* (2006.01)

(52) U.S. Cl. ..... 114/264; 405/195.1; 405/205; 405/210; 405/224.2

(58) Field of Classification Search ..... 114/264, 114/266, 267; 405/195.1, 205, 210, 224.2
See application file for complete search history.

(56) References Cited

U.S. PATENT DOCUMENTS 3,419,090 A 12/1968 Van Dorn
4,241,685 A 12/1980 Mougin
4,702,321 A * 10/1987 Horton ..... 114/264
6,176,646 B1 1/2001 Finn et al.
6,206,614 B1 * 3/2001 Blevins et al. ..... 114/264
6,309,141 B1 * 10/2001 Cox et al. ..... 405/195.1
6,336,421 B1 * 1/2002 Fitzgerald et al. ..... 114/264

(Continued)

FOREIGN PATENT DOCUMENTS

FR 96425 6/1972

(Continued)

OTHER PUBLICATIONS

International Search Report on corresponding PCT application (PCT/US2007/076133) from International Searching Authority (EPO) dated Jan. 23, 2008.

(Continued)

*Primary Examiner*—Lars A Olson
(74) *Attorney, Agent, or Firm*—Klein, O'Neill & Singh, LLP

(57) ABSTRACT

A spar platform for use in the offshore drilling or production of fossil fuels includes a hull having a centerwell. An airtight and watertight barrier traverses the centerwell, forming a variable buoyancy compartment in the centerwell. In certain embodiments the centerwell is open at the bottom to the sea, while in certain other embodiments the centerwell is sealed at the bottom. At least one sleeve for accommodating a riser extends through the barrier and the variable buoyancy compartment to the bottom of the centerwell. The sleeve has an open upper end to provide a drain for water accumulating in the centerwell, and it forms an airtight and watertight seal at its juncture with the barrier. In some embodiments, two or more airtight and watertight barriers are provided across the centerwell, defining an airtight and watertight fixed buoyancy chamber between each adjacent pair of barriers.

16 Claims, 3 Drawing Sheets

U.S. PATENT DOCUMENTS 6,854,933 B2 * 2/2005 Horton, III ..... 114/264

FOREIGN PATENT DOCUMENTS

| | | |
|---|---|---|
| FR | 2472631 | 7/1981 |
| GB | 2008051 | 5/1979 |
| WO | WO 98/21415 | 5/1998 |

OTHER PUBLICATIONS

Written Opinion on corresponding PCT application (PCT/US2007/076133) from International Searching Authority (EPO) dated Jan. 23, 2008.

* cited by examiner

SPAR PLATFORM HAVING CLOSED CENTERWELL

CROSS-REFERENCE TO RELATED APPLICATIONS

This application claims priority from provisional application Ser. No. 60/822,631, filed Aug. 16, 2006, the disclosure of which is incorporated herein by reference in its entirety.

BACKGROUND OF THE INVENTION

1. Field of the Invention

The present embodiments relate to offshore drilling and production platforms, particularly spar-type platforms.

2. Description of Related Art

Spar-type offshore drilling and production platforms typically include vertically elongated buoyant hulls. For example, FIG. 1 illustrates an example spar platform 100 having an outer hull 102 with a hollow centerwell 104 that is open to the sea at its lower end, and open to the atmosphere at its upper end. The hull 102 supports a deck (not shown) on which drilling and production equipment (not shown) may be mounted, along with other structures. The hull 102 includes a plurality of buoyancy tanks 106 surrounding the centerwell 104. The buoyancy tanks 106 define voids or compartments 108 that may be selectively filled with air or water to provide varying degrees of buoyancy to the platform 100. The buoyancy tanks 106 extend down to a truss structure 110, which, in turn, extends down to a ballasted keel 112. The ballasted keel 112 at the bottom of the truss structure 110 lowers the center of gravity of the platform 100 and improves the stability of the platform 100. One or more mooring lines (not shown) may be used to keep the platform 100 over its station.

Spar platforms are typically used in conjunction with one or more risers that extend under tension from the platform to a wellhead or an anchor on the seafloor. For example, the platform 100 of FIG. 1 includes top-tensioned risers (TTRs) 116. The TTRs 116 extend downward through the centerwell 104 from hydraulic-pneumatic tensioners (not shown) supported on a top-tensioned riser support frame 118. The hull 102 supports the support frame 118 above the surface 120 of a body of water (e.g., the sea). In alternative spar platforms, the TTRs may be supported by a buoyancy can (not shown) floating in the open centerwell. Such a configuration is disclosed in U.S. Pat. No. 6,176,646, the disclosure of which is incorporated herein by reference in its entirety. Alternative spar platforms may include catenary risers and/or bottom tensioned risers (BTRs) that are used to import oil and/or gas from remote fields or to export oil and/or gas to the shore or to other platforms. These risers are generally located in the open centerwell, and the platform may include pull tubes or containment tubes for surrounding and containing the risers. In some cases, catenary risers may be located on the outside of the platform and mm along the length of the platform. Other utility pipes that are open at the bottom may also be located in the centerwell.

As understood from FIG. 1, the centerwell 104 is open to the sea at its bottom and flooded with sea water. Accordingly, the centerwell 104 does not contribute to the buoyancy of the platform 100.

SUMMARY OF THE INVENTION

The preferred embodiments of the present spar platform have several features, no single one of which is solely responsible for their desirable attributes. Without limiting the scope of the present embodiments as expressed by the claims that follow, their more prominent features will now be discussed briefly. After considering this discussion, and particularly after reading the section entitled "Detailed Description of the Preferred Embodiments." one will understand how the features of the present embodiments provide several advantages, including, without limitation, increased buoyancy, reduced size and weight, and simple and effective means to adjust the buoyancy of the platform as conditions change.

One aspect of the present spar platform includes the realization that in a typical spar platform, the centerwell is open to the sea and flooded. The centerwell thus provides no buoyancy contribution to the platform. Sealing off part or all of the centerwell would advantageously increase the buoyancy of the platform and enable the centerwell to provide adjustable buoyancy to the platform. Sealing off part or all of the centerwell would also advantageously help to reduce the diameter and size of the spar platform, thereby generating weight savings. The reduction in weight and volume would also enhance the ability of the spar platform to be built and transported in one piece using existing heavy lift vessels.

Broadly, and in accordance with the above realizations, a spar platform in accordance with the present invention comprises a hull; a centerwell disposed within the hull and having a lower end open to the sea; a transverse barrier disposed within the centerwell so as to define a variable buoyancy compartment at the lower end of the centerwell, the variable buoyancy compartment being open to the sea; and a sleeve extending through the barrier and the compartment, wherein the sleeve forms an airtight and watertight seal at its junction with the barrier.

In one specific embodiment, the barrier is an airtight and watertight deck. In another specific embodiment, the barrier comprises at least first and second airtight and watertight decks defining an airtight and watertight fixed buoyancy chamber between them, with the sleeve extending through the fixed buoyancy chamber from the first deck, through the second deck, and through the compartment. The sleeve may advantageously be configured to accommodate a riser extending through it. The sleeve forms airtight and watertight seals at its respective junctures with the first and second decks.

As used herein, the terms "invention" and "present invention" are to be understood as encompassing the invention described herein in its various embodiments and aspects, as well as any equivalents that may suggest themselves to those skilled in the pertinent arts.

BRIEF DESCRIPTION OF THE DRAWINGS

The preferred embodiments of the present spar platform will now be discussed in detail with an emphasis on highlighting the advantageous features. These embodiments depict the novel and non-obvious spar platform shown in the accompanying drawings, which are for illustrative purposes only. These drawings include the following figures, in which like numerals indicate like parts.

DETAILED DESCRIPTION OF THE PREFERRED EMBODIMENTS

Figure 1:
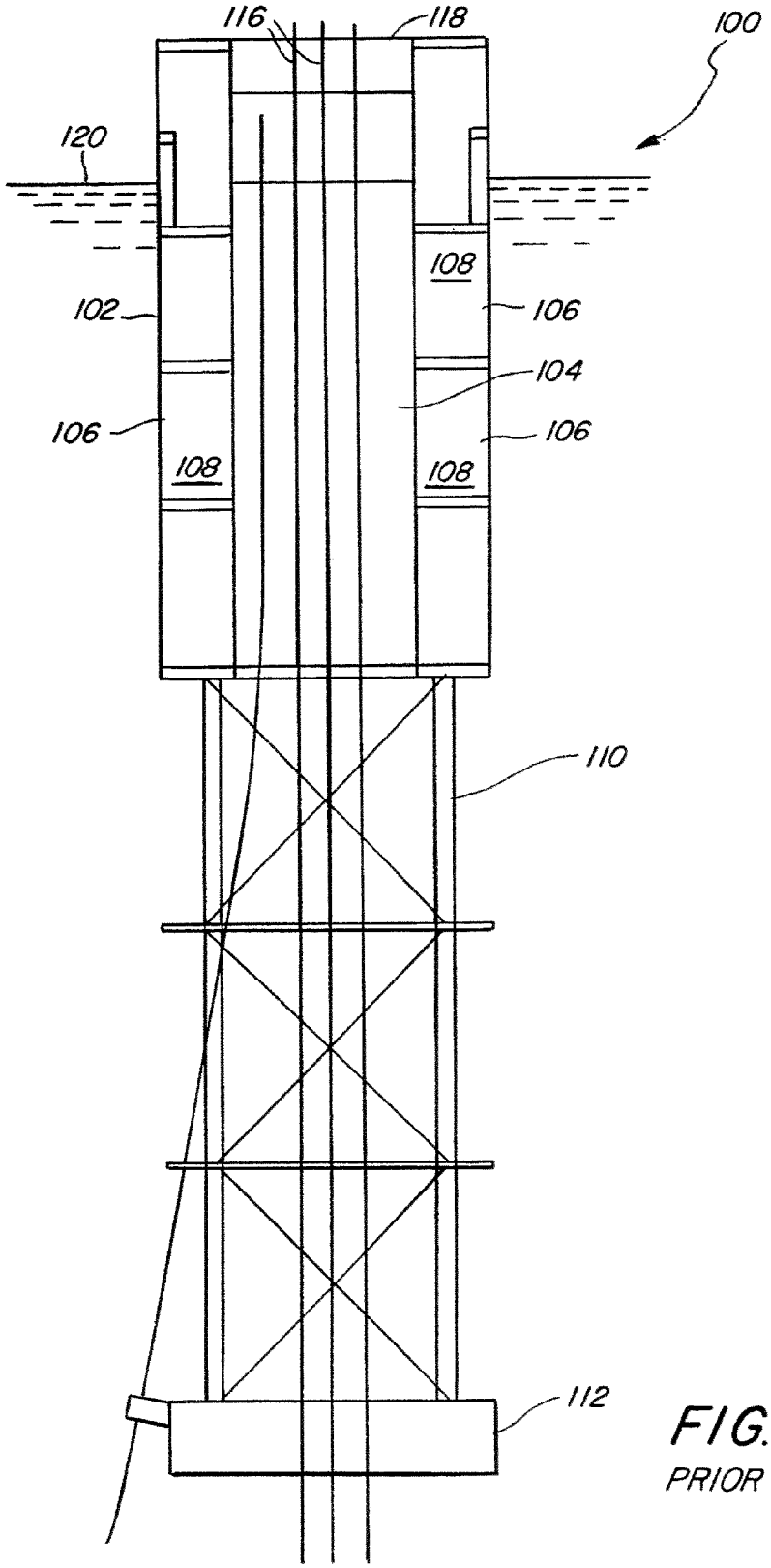
FIG. 1 PRIOR ART
FIG. 1 is a cross-sectional side elevation view of a prior art spar platform.
Figure 2:
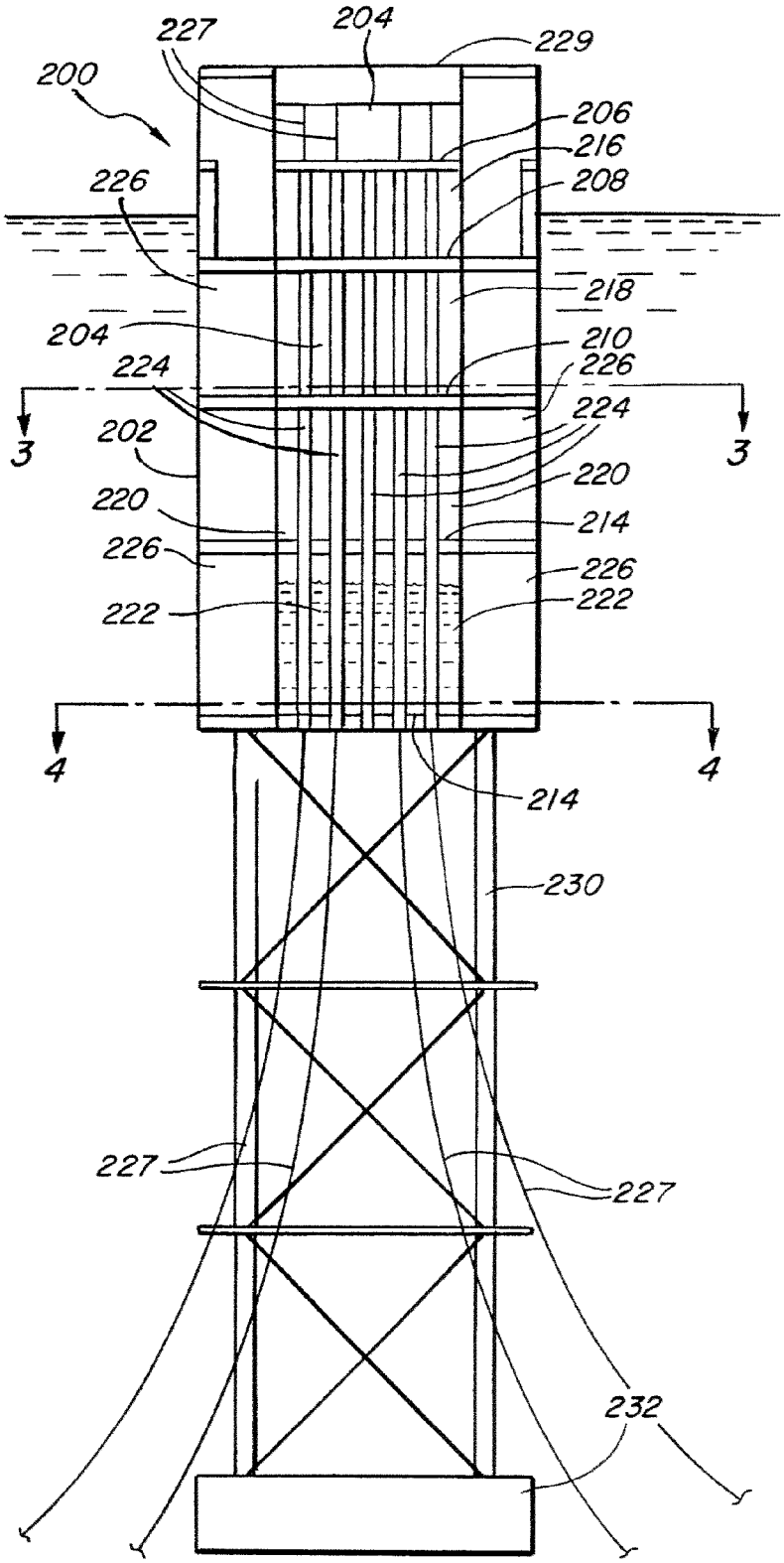
FIG. 2 is a cross-sectional side elevation view of one embodiment of the present spar platform.

FIG. 2 illustrates a cross-sectional side elevation view of one embodiment of the present spar platform 200. Although the present embodiments are described herein with reference to a truss spar platform, those of ordinary skill in the art will appreciate that the present embodiments encompass any floating production and/or drilling platform or vessel having an open centerwell configuration.

As shown in FIG. 2, the spar platform 200 includes a hull 202 having a centerwell 204. The centerwell 204 has an upper end that is open to the atmosphere, and a lower end that is open to the sea. A plurality of airtight and watertight barriers 206, 208, 210 extend substantially horizontally across the centerwell 204. In a specific embodiment, one or more of the barriers 206, 208, 210 may be in the form of a non-airtight/watertight deck. For simplicity, in the description below the barriers 206, 208, 210 will be referred to as decks, even though in certain embodiments one or more of these barriers 206, 208, 210 may not be airtight or watertight.

Figure 4:
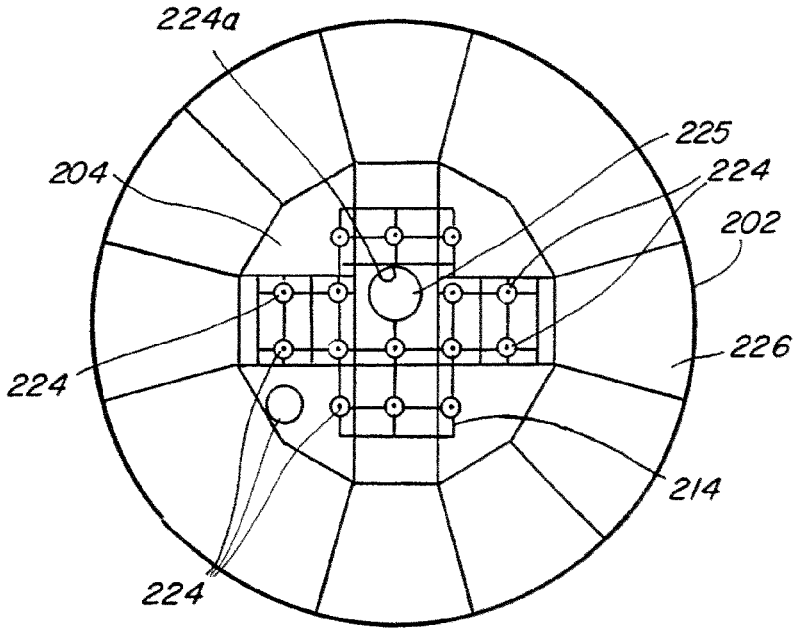
FIG. 4 is a cross-sectional top plan view of the spar platform of FIG. 2, taken through the line 4-4.

The first and second decks 206, 208 define a first airtight and watertight fixed buoyancy chamber 216 between them. The second and third decks 208, 210 define a second airtight and watertight fixed buoyancy chamber 218 between them. One or more support or guide frames 214 may be provided across the centerwell 204 below the third deck 210. In the illustrated embodiment, two support or guide frames 214 are provided, with the lowermost frame 214 being located near the lower end of the centerwell 204, as shown in FIGS. 2 and 4. Those of ordinary skill in the art will appreciate that fewer or more support or guide frames 214 may be provided. The function of the support or guide frames 214 is discussed in detail below.

Figure 3:
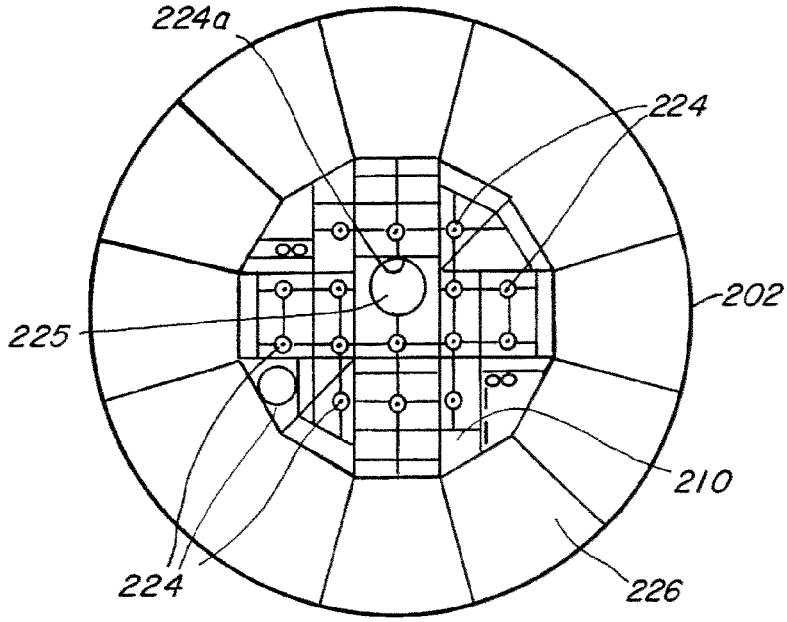
FIG. 3 is a cross-sectional top plan view of the spar platform of FIG. 2, taken through the line 3-3.

A plurality of sleeves 224 extend in a substantially vertical (axial) direction through the centerwell 204, from the uppermost deck 206 to the bottom of the centerwell 204. In the illustrated embodiment, five sleeves 224 are shown, but it will be appreciated that fewer or more sleeves 224 could be provided. One of the sleeves 224, preferably near the center of the centerwell 204, may be a moon pool sleeve **224*a* (see FIGS. 3 and 4), and it may be larger in diameter than the other sleeves 224 so as to provide a moon pool 225 that extends downwardly from the uppermost deck 206 to the lower end of the centerwell 204. The sleeves 224, 224*a* are supported by the support or guide frames 214 as the sleeves extend through the centerwell 204 below the decks 206, 208, 210. The sleeves 224 are advantageously dimensioned to receive and accommodate risers 227, which may be top-tensioned risers (TTRs), bottom-tensioned risers (BTRs), or steel catenary risers (SCRs), either with or without riser casings (not shown). The TTRs may be supported by a top-tensioned riser support frame 229 with associated conventional riser tensioners (not shown), as is well-known in the art. Other containment tubes and/or pull tubes (not shown), such as those for catenary risers, umbilicals, moon pools and/or caissons, may also be provided in the centerwell 204**.

The hull 202 includes a plurality of buoyancy tanks or hard tanks 226 surrounding the centerwell 204. The buoyancy tanks 226 may be selectively and controllable filled with air or water, by conventional means, to provide varying degrees of buoyancy to the platform 200. The buoyancy tanks 226 extend down to a truss structure 230, which extends down to a ballasted keel 232. The ballasted keel 232 at the bottom of the truss structure 230 lowers the center of gravity of the platform 200 and improves the stability of the platform 200. One or more mooring lines (not shown) may be used to keep the platform 200 over its station. Those of ordinary skill in the art will appreciate that certain embodiments of the present spar platform may not include a truss structure or a ballasted keel.

As described above, the decks 206, 208, 210 are airtight and watertight. Accordingly, the intersections of the sleeves 224, **224*a* with the decks 206, 208, 210 are similarly airtight and watertight. For example, the sleeves 224, 224*a* may be welded to the decks 206, 208, 210 in an airtight and watertight fashion. Those of ordinary skill in the art will appreciate that as used herein the term "sleeve" encompasses both continuous and segmented structures. Thus, each sleeve 224, 224*a* may comprise a single unitary length of material extending from the uppermost deck 206 to the lowermost support or guide frame 214, or each sleeve 224, 224*a* may be constructed of a plurality of shorter segments that may be connected together and/or connected to the decks 206, 208, 210 and guide frames 214. In embodiments where the sleeve(s) 224, 224*a* are constructed of a plurality of shorter segments, openings in the deck(s) 206, 208, 210** may be considered to be part of the sleeves.

In certain embodiments, the airtight and watertight buoyancy chambers 216, 218 are filled with air, thus adding buoyancy to the spar platform 200. Because the sleeves 224, **224*a* passing through the fixed buoyancy chambers 216, 218 are likewise airtight and watertight, as are the junctures between the sleeves 224, 224*a* and the decks 206, 208, 210, any water in the sleeves 224 will not seep into the fixed buoyancy chambers 216, 218 and interfere with their buoyancy contribution to the spar platform 200. Furthermore, the sleeves 224 have open upper ends in the uppermost deck 206, so that any water accumulating on the uppermost deck 206 is drained through the sleeves 224** and into the sea.

A variable buoyancy compartment 220, defined below the lowermost deck 210, has an open bottom coinciding with the open bottom of the centerwell 204. Because this variable buoyancy compartment 220, also referred to as a compressed air over water chamber, is open to the sea, seawater 222 may move in and out of the compartment 220 naturally. The amount of air and water in the variable buoyancy compartment 220 may be adjusted by adding air from a source of compressed air (not shown) or by bleeding air from the compartment 220 to the sea or to the atmosphere. The provision of compressed air and the bleeding of air may be performed by conventional mechanisms that are well-known in the art, and therefore need not be described in this specification. By controllably changing the ratio of air to water within the compartment 220, the buoyancy contribution of the variable buoyancy compartment 220 to the platform 200 may be controllably adjusted. Because the sleeves 224 passing through the variable buoyancy compartment 220 are airtight and watertight, any air and/or water in the sleeves 224 will not seep into the variable buoyancy open bottom compartment 220 and interfere with its buoyancy contribution to the spar platform 200.

In certain embodiments the sleeves 224 are open at both ends. The sleeves 224 are thus at least partially filled with seawater that enters through the lower end of each sleeve 224. As mentioned above, the sleeves 224 also advantageously act as drains for the uppermost deck 206. Water or other liquids collecting on the deck 206 may drain through the open upper ends of the sleeves 224 and drain down through the sleeves 224 to the level of seawater contained in each sleeve 224. The drainage advantageously prevents excessive accumulation of liquids on the deck 206, which could increase the weight at the upper end of the platform 200 and possibly upset the balance of the platform 200, or cause sloshing or other detrimental effects.

The embodiments described above advantageously provide watertight compartments 216, 218 in the centerwell 204 that increase the buoyancy of the spar platform 200. Sealing off the lower part of the centerwell 204 by at least one watertight and airtight transverse barrier or deck also advantageously helps to reduce the diameter and size of the spar platform 200, thereby generating weight savings. The reduction in weight and volume also enhances the ability for the spar platform 200 to be built and transported in one piece using existing heavy lift vessels.

The embodiments described above also advantageously provide the variable buoyancy or compressed air over water compartment 220. The adjustable buoyancy of the variable buoyancy compartment 220 provides a simple and effective means for adjusting the buoyancy of the spar platform 200 as conditions aboard the platform 200 change. For example, as risers and/or topside equipment is added or removed over the life of the platform 200, the buoyancy of the variable buoyancy compartment 220 may be adjusted to maintain the balance of the platform 200. The compressed air buoyancy system is also advantageously simpler than a water ballast system using marine ballast pumps.

Although the illustrated embodiment includes three airtight and watertight decks 206, 208, 210 and two airtight and watertight compartments 216, 218 in the centerwell 204, those of ordinary skill in the art will appreciate that the present embodiments encompass a centerwell having any number of airtight and watertight decks and compartments. Specifically, the advantages of the present spar platform, as described above, may be realized by employing only a single airtight and watertight transverse barrier or deck (e.g. the deck 206 shown in the drawings). In such an embodiment, the single barrier divides the centerwell into an upper portion that is open to the atmosphere, and a lower portion, open to the sea, that provides the variable buoyancy compartment 220, and there are no buoyancy chambers defined between two or more decks. Similarly, if only two airtight and watertight barriers or decks are provided, there will be a single buoyancy chamber defined between them. In another embodiment, three or more such barriers or decks may be provided, with a buoyancy chamber defined between each adjacent pair of barriers or decks.

In an alternative embodiment of the present spar platform a lower end of the centerwell may be sealed by an airtight and watertight barrier. The airtight and watertight barrier may be substantially identical to the decks 206, 208, 210 described above and illustrated in FIGS. 2 and 3. In this embodiment seawater may not flow in and out of the centerwell naturally as in the embodiment of FIGS. 2-4. However, in certain embodiments having a closed lower end seawater may be added to and/or removed from the centerwell to adjust the buoyancy of the platform. The seawater may be added and/or removed using, for example, pumps (not shown). As in the embodiment of FIG. 2, airtight and watertight sleeves may extend through the centerwell, and in certain embodiments the sleeves may extend from the uppermost barrier or deck to the lowermost barrier or deck.

The above description presents the best mode contemplated for carrying out the present invention, and of the manner and process of making and using it, in such full, clear, concise, and exact terms as to enable any person skilled in the art to which it pertains to make and use this spar platform. The present invention is, however, susceptible to modifications and alternate constructions, in addition to those discussed above, that are fully equivalent. Consequently, the present invention is not limited to the particular embodiments disclosed herein. On the contrary, the present invention encompasses all modifications and alternate constructions coming within the spirit and scope of the invention, as generally expressed by the following claims, which particularly point out and distinctly claim the subject matter of the invention.

What is claimed is:

1. A spar platform for use in the offshore drilling or production of fossil fuels from the bed of a sea, the platform comprising:

a hull;

a centerwell disposed within the hull;

an airtight and watertight transverse barrier disposed within the centerwell so as to define an adjustably variable buoyancy compartment within the centerwell; and a sleeve extending through the barrier and the adjustably variable buoyancy compartment, wherein the sleeve forms an airtight and watertight seal at its junction with the barrier.

2. The spar platform of claim 1, wherein the centerwell has a lower end that is open to the sea.

3. The spar platform of claim 2, wherein the adjustably variable buoyancy compartment is located at the lower end of the centerwell.

4. The spar platform of claim 1, wherein the airtight and watertight transverse barrier is located at a lower end of the centerwell and seals, the centerwell from the sea.

5. The spar platform of claim 1, wherein the transverse barrier comprises a first barrier, and further comprising a second airtight and watertight transverse barrier, the first and second barriers defining a fixed buoyancy chamber therebetween.

6. The spar platform of claim 5, wherein the sleeve extends through the first barrier, the second barrier, and the fixed buoyancy chamber and forms an airtight and watertight seal at its junctures with the first and second barriers.

7. The spar platform of claim 1, wherein the platform has a buoyancy that is adjustable by varying a ratio of air to water within the adjustably variable buoyancy compartment.

8. The spar platform of claim 7, wherein the ratio of air to water within the adjustably variable buoyancy compartment is adjustably variable by selectively adding air to the compartment and removing air from the compartment.

9. The spar platform of claim 7, wherein the ratio of air to water within the adjustably variable buoyancy compartment is adjustably variable by selectively adding water to the compartment and removing water from the compartment.

10. The spar platform of claim 1, wherein the sleeve is configured to allow water in the centerwell to drain therethrough to the sea.

11. A method of adjusting a buoyancy of a spar platform for use in the offshore drilling or production of fossil fuels from the bed of a sea, the method comprising the step of:

adjustably varying a ratio of air to water within an adjustably variable buoyancy compartment of the platform, wherein the adjustably variable buoyancy compartment is located within a centerwell of the platform.

12. The method of claim 11, wherein the step of adjustably varying the ratio of air to water within the adjustably variable buoyancy compartment comprises selectively adding air to the compartment and removing air from the compartment.

13. The method of claim 11, wherein the step of adjustably varying the ratio of air to water within the adjustably variable buoyancy compartment comprises selectively adding water to the compartment and removing water from the compartment.

14. A method of constructing a spar platform for use in the offshore drilling or production of fossil fuels from the bed of a sea, the method comprising the steps of:

assembling a hull of the platform, the hull containing a centerwell;

securing an airtight and watertight transverse barrier within the centerwell, the barrier defining a boundary of an adjustably variable buoyancy compartment within the centerwell; and extending a sleeve through the barrier and the adjustably variable buoyancy compartment, wherein the sleeve forms an airtight and watertight seal at its junction with the barrier.

15. The method of claim 14, wherein the transverse barrier comprises a first barrier, and further comprising the step of securing a second airtight and watertight transverse barrier within the centerwell, the first and second barriers defining a fixed buoyancy chamber therebetween.

16. The method of claim 14, wherein the step of extending the sleeve through the barrier comprises welding the sleeve to the barrier.

* * * * *

UNITED STATES PATENT AND TRADEMARK OFFICE

CERTIFICATE OF CORRECTION

PATENT NO. : 7,565,877 B2
APPLICATION NO. : 11/840039
DATED : July 28, 2009
INVENTOR(S) : Anil Sablok et al.

It is certified that error appears in the above-identified patent and that said Letters Patent is hereby corrected as shown below:

In column 1, line 55, delete “mm” and insert -- run --, therefor.

In column 2, line 5, delete “Embodiments.”” and insert -- Embodiments,” --, therefor.

Signed and Sealed this

Twenty-second Day of December, 2009

David J. Kappos

David J. Kappos
*Director of the United States Patent and Trademark Office*